US006732960B2

(12) United States Patent
Shaw et al.

(10) Patent No.: US 6,732,960 B2
(45) Date of Patent: May 11, 2004

(54) SYSTEM AND METHOD FOR BLOWING LOOSE-FILL INSULATION

(75) Inventors: Wayne Shaw, Glen Mills, PA (US); Joseph Michetti, Springfield, PA (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 10/188,950

(22) Filed: Jul. 3, 2002

(65) Prior Publication Data

US 2004/0004136 A1 Jan. 8, 2004

(51) Int. Cl.[7] ..... B05B 5/00

(52) U.S. Cl. ..... 239/690; 239/690.1; 239/697; 239/698; 239/706

(58) Field of Search ..... 239/690, 690.1, 239/697, 698, 706; 361/212–213, 220, 229–230; 406/122–153, 198

(56) References Cited

U.S. PATENT DOCUMENTS 4,057,071 A * 11/1977 Rhodes ..... 137/1
4,286,210 A * 8/1981 Ignatjev ..... 324/72.5
4,289,980 A * 9/1981 McLaughlin ..... 307/116
4,555,447 A 11/1985 Sieloff et al. ..... 428/392
4,870,535 A * 9/1989 Matsumoto ..... 361/215
4,882,485 A * 11/1989 Duryea ..... 250/288
5,351,415 A * 10/1994 Brooks et al. ..... 34/389
5,535,945 A * 7/1996 Sferrazza et al. ..... 241/24.12
5,539,598 A * 7/1996 Denison et al. ..... 360/323
5,837,064 A * 11/1998 Bowers ..... 134/6
5,898,559 A * 4/1999 Smith ..... 361/215
5,947,646 A 9/1999 Lytle ..... 406/48
5,949,635 A * 9/1999 Botez ..... 361/213
6,012,263 A 1/2000 Church et al. ..... 52/742.13
6,150,945 A * 11/2000 Wilson ..... 340/661
6,155,020 A * 12/2000 Deem ..... 52/742.13
6,262,164 B1 * 7/2001 Church et al. ..... 524/494
6,329,052 B1 * 12/2001 Groh et al. ..... 428/360
6,419,171 B1 * 7/2002 Takayanagi ..... 239/690
6,503,026 B1 * 1/2003 Mitchell ..... 406/128
6,507,473 B2 * 1/2003 Richie et al. ..... 361/213

OTHER PUBLICATIONS

Simco Manual, Static Basics, pp. 4–5, The SIMCO Company, Inc., Hatfield, PA.
Simco Operations/Maintenance—Conveyostat Static Neutralizers, The SIMCO Company, Inc., Hatfield, PA, Publication 5100577, Revision A, Mar. 1993, pp. 1–2.

* cited by examiner

*Primary Examiner*—Henry Bennett
*Assistant Examiner*—Amanda Flynn
(74) *Attorney, Agent, or Firm*—Duane Morris LLP

(57) ABSTRACT

A system for blowing loose-fill insulation includes a loose-fill blowing machine including a discharge hose. An ionizer is disposed in the flow path of the insulation through the discharge hose, wherein the ionizer reduces the static charge developed on the insulation prior to discharge thereof. A method of reducing static charge developed on loose-fill insulation during blowing is also provided and includes the step of ionizing the insulation in the flow path of the insulation while the insulation is being discharged to reduce the static charge.

20 Claims, 2 Drawing Sheets

SYSTEM AND METHOD FOR BLOWING LOOSE-FILL INSULATION

FIELD OF THE INVENTION

The present invention relates to loose-fill insulation blowing systems and methods, and more particularly to methods and systems for reducing static charge developed on the surface of loose-fill insulation during manufacturing, packaging preconditioning and blowing thereof.

BACKGROUND OF THE INVENTION

The use of fiberglass loose-fill insulation is well known and preferred by many contractors because it can easily and quickly be applied to new and old building structures and is a relatively low cost material. The loose-fill insulation is typically blown through a discharge hose to a desired area, such as open cavities in floors and walls of attics. Often, the blown loose-fill insulation, being a dialectic material, carries a static charge on its surface as it flows through the discharge hose towards the discharge nozzle, particularly in relatively dry environments. This static charge is generated as the insulation travels through the hose and/or before the insulation enters the hose. This static charge causes the fibers to repel each other after discharge, thereby causing the fibers to spread out in a cloud formation and adversely affects control of the discharge stream. The charge also causes the fibers to stick to undesired surfaces and to operators, causing efficiency losses and skin irritation.

One method of countering this static charge problem is through the use of antistatic agents, such as quarternary ammonium salts. One such method and system is proposed in U.S. Pat. No. 4,555,447 to Sieloff et al., entitled "Blowing Wool Insulation" issued Nov. 26, 1985. Antistatic agents for controlling surface static charge, however, tend to be expensive, corrosive and hydrophilic. Therefore, reduction or elimination of these static control agents in blowing systems and methods is desirable, while still adequately addressing the aforementioned problems associated with the static charge phenomenon.

SUMMARY OF THE INVENTION

A system for blowing loose-fill insulation includes a loose-fill blowing machine including a discharge hose. An ionizer is disposed in the flow path of the insulation through the discharge hose, wherein the ionizer reduces the static charge developed on the loose-fill insulation prior to discharge thereof. A method of reducing static charge developed on loose-fill insulation during blowing is also provided and includes the step of ionizing the insulation in the flow path of the insulation while the insulation is being discharged in order to reduce the static charge. The system and method eliminate, at least in part, the need for antistatic chemicals in loose-fill blowing systems, while reducing static charge build up on the loose-fill insulation and avoiding the distribution problems associated therewith.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
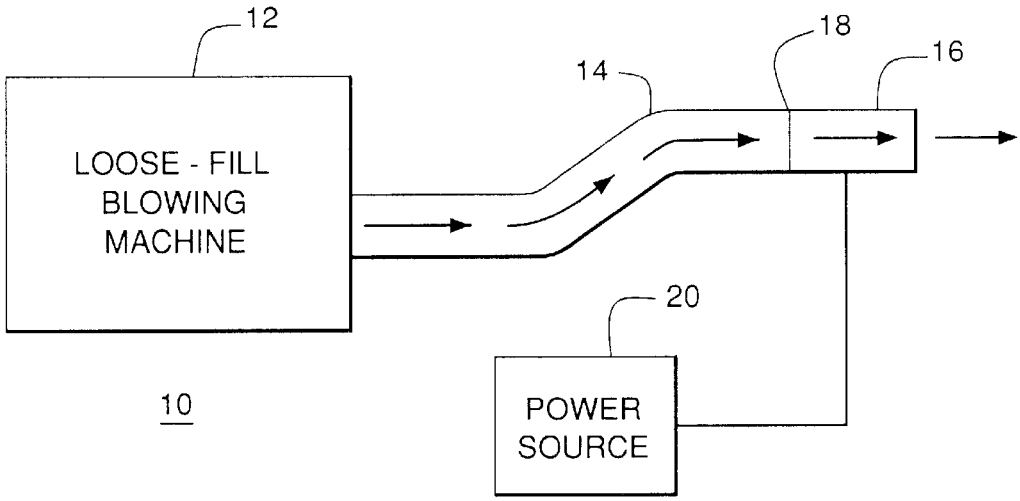
FIG. 1 is a block diagram of a system for blowing loose-fill insulation.

FIG. 1 is a block diagram of a system 10 for blowing loose-fill insulation, such as loose-fill insulation including glass fibers. The system 10 includes a loose-fill blowing machine 12, the details of which should be known to those familiar with loose-fill blowing systems and are not repeated herein. One exemplary loose-fill insulation blowing machine 12 is Unisul blowing machine model VOLU-MATIC 3 available from Unisul of Winter Haven, Fla. A discharge hose 14 is connected to the loose-fill blowing machine 12 and terminates at a discharge opening 18. The discharge hose 14 has a length sufficient to extend from a vehicle (or other location) housing the loose-fill blowing machine 12, for example, to a desired blowing area in a house or other structure. The discharge hose 14 is typically between about one hundred to two hundred feet long. The flow path of the loose-fill insulation through the system 10 is indicated by arrows in FIG. 1.

The system 10 includes an ionizer 16 (also known as an ion generator or static eliminator) disposed in the flow path of the blown loose-fill insulation. The ionizer 16 is preferably, but not necessarily, disposed proximate to the discharge opening 18 in order to neutralize any static charge developed on the surface of the loose-fill fibers as they flow through the length of discharge hose 14. It can be located just outside this opening 18, such as an attachment to the end of discharge hose 14, or at any point along or within the discharge hose 14, for example.

One exemplary ionizer includes static bars that ionize surrounding air, continuously creating charged particles that are available to combine with oppositely charged particles on the surface of the loose-fill insulation as it flows through or around the ionizer 16. Examples of such ionizers include active static eliminators, hot static eliminators and shockless static eliminators. One exemplary ionizer is a tubular shaped active or hot ionizer available from Simco Industrial Static Control of Hatfield, Pa., under the trademark CONVEYOSTAT, product number 4002857. The CONVEYOSTAT ionizer is available in a variety of different sized models having diameters ranging from 1.5–24 inches, thereby facilitating the coupling of the ionizer to a range of different sized discharge hoses 14 and more effectively making the tubular ionizer a part of the discharge hose 14 and flow path of the loose-fill insulation.

The ionizer 16 is shown coupled to a power source 20. One exemplary power source is a dual phase power supply, 120 V at 60 Hz, also available from Simco.

The system 10 of FIG. 1 was tested. A Simco CONVEYOSTAT tubular ionizer was connected to the end of a standard 4 inch diameter discharge hose at its discharge opening. The testing room environment was approximately 20% humidity with a temperature of about 70–72° F. The ionizer was initially installed but turned "off". One bag of standard I/S 4 (INSULSAFE No. 4) loose-fill insulation, available from CertainTeed Corp. of Valley Forge, Pa., was blown and the static charge level of the insulation and blow pattern of the loose-fill were observed. The insulation evidenced some static charge (e.g., by clinging to wooden joists positioned on the floor) and tended to balloon out upon discharge, which is typical behavior for insulation blown at such a low level of humidity. In the second experimental run, the ionizer was turned "on" and another bag of standard I/S 4 was blown. The observed blow pattern was much more consolidated, with virtually no unwanted fibers clinging to the wooden joists or walls. In addition, none of the loose-fill insulation drifted back towards the operator. This blowing process was repeated for approximately two to three more bags of the I/S 4 loose-fill insulation. During the blowing test, the ionizer was periodically switched "on" and "off". In each "on"-"off" cycle, when the ionizer was turned "on", static was quickly reduced. Some level of static charge returned when the ionizer was turned "off". A static meter was also employed to measure static levels and to confirm these observations.

This experiment was also run with the addition of $CaCO_3$ to the loose-fill glass fiber. The $CaCO_3$ increases the insulative abilities of the loose-fill insulation but also has a deleterious affect on the build up of static charge on blown loose-fill insulation. The ionizer was again periodically switched "on" and "off". The static charge on the loose-fill insulation was eliminated when the unit was turned "on", and some level of charge returned when the ionizer was turned "off". Similar results were observed when the test was run for bags of BCR3P, which is a loose-fill like material used as reinforcement in composite materials, such as Fiberglass Reinforced Plastics (FRP).

For each of the above-described test runs, the static charge level of the blown insulation was measured at the discharge opening of the discharge hose and the insulation stream diameter was measured at approximately 36 inches from the discharge opening. In each test, significant reductions in static level, stream diameter and stream cross-sectional area were noted, the results of which are indicated in the following table. The following table also indicated that the ionizer is capable of neutralizing both positive and negative static charge, i.e., it generates an ion field including both anionic and cationic ions.

| Blown Material | Ionizer ON/OFF | Static Level @ discharge (kV) | Blown Insulation Stream Diameter (inches) | % Decrease in Stream Cross-Sectional Area |
|---|---|---|---|---|
| I/S 4 | OFF | −7.4 | 12 | |
| I/S 4 | ON | −0.55 | 8 | 56% |
| BCR3P | OFF | −3.5 to −6.5 | 16 | |
| BCR3P | ON | −0.7 to −0.9 | 12 | 44% |
| Added $CaCO_3$ | OFF | +17 | 22 | |
| Added $CaCO_3$ | ON | −2.2 | 12 | 70% |

In a last set of test runs, the ionizer was placed in between two sections of discharge hose, with approximately fifty feet of hose between the ionizer and the discharge opening. In this experiment, the ionizer was not effective at eliminating the static charge. This test was then repeated, but the ionizer was moved to within ten feet of the discharge opening of the hose. It was observed that the ionizer, once moved closer to the discharge opening 18, was effective in eliminating at discharge the static charge developed on the blown insulation. Accordingly, it is desirable for the ionizer to be disposed within twenty-five feet (25 ft), and preferably ten feet (10 ft), from the discharge opening 18, or, most preferably, right outside of the discharge opening 18.

Figure 2:
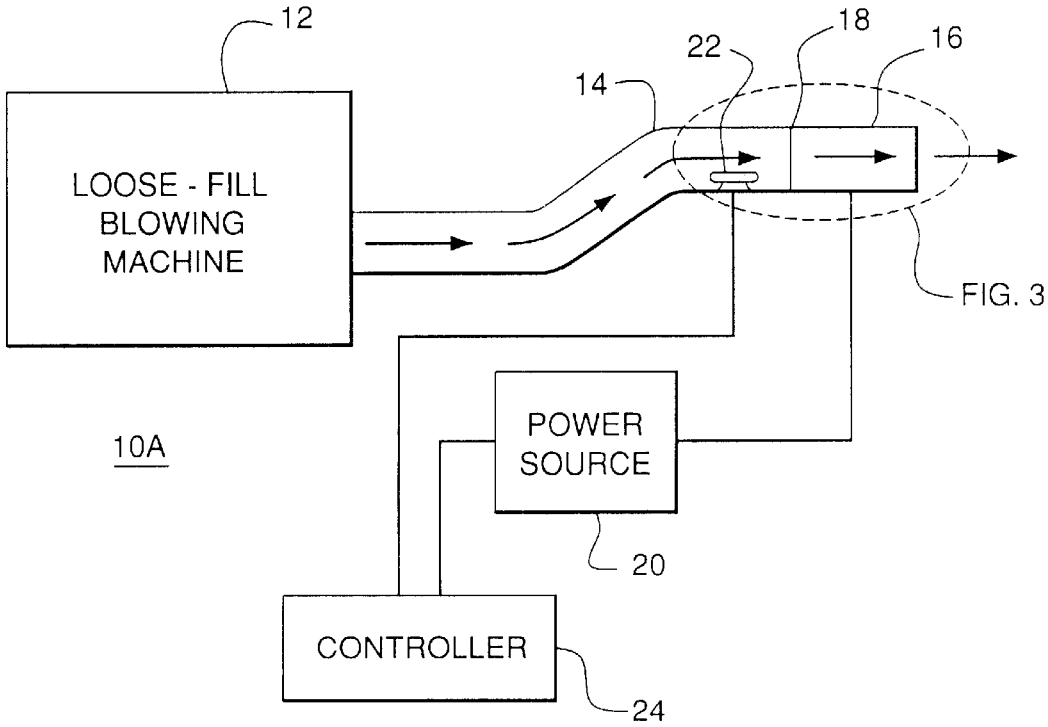
FIG. 2 is a block diagram of a system for blowing loose-fill insulation including a control loop.

FIG. 2 is a block diagram of a loose-fill blowing system 10A including a closed loop control system. The system 10A is the same as system 10 of FIG. 1, only further including static sensor 22 and controller 24. The static sensor 22 measures the level of static charge present on the surface of the loose-fill that passes by the sensor 22. The sensor 22 is shown disposed in the hose 14, preferably before and proximate to the ionizer 14, but the sensor 22 could also be placed at or near the discharge opening 18 if the ionizer 16 is relocated closer to the machine 12. One example of an appropriate sensor 22 for system 10A is the Model 621 Static Monitor available from Electro-Tech Systems, Inc. of Glenside, Pa. The sensor 22 develops a static measurement signal that is indicative of the level of static charge developed on the loose-fill insulation. This signal is provided to controller 24, which is microprocessor based and may be a microncontroller or programmable logic controller. The controller 24 is programmed to control the ionizer 16 via its power source 20 based upon or in response to the measurement signal received from the sensor 22. The controller 24, for example, may be programmed to increase the power output to the ionizer if any or high levels of static are detected or to decrease the output power as appropriate. The controller 24 may also switch the ionizer "off" when no static charge is detected, such as when no loose-fill is being blown through the discharge hose and "on" as static charge is detected.

Figure 3:
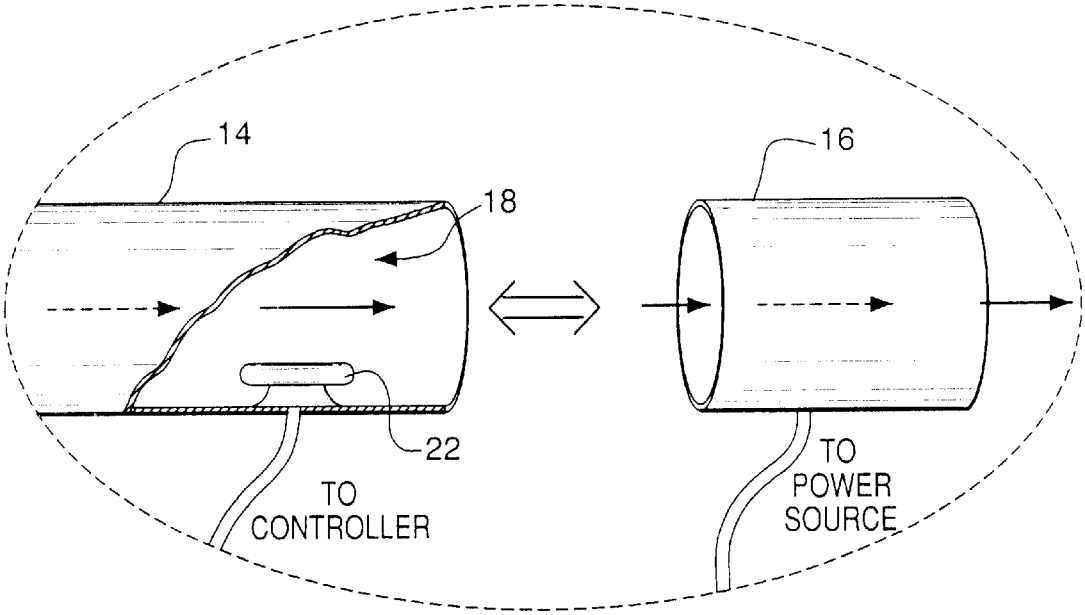
FIG. 3 is a partial exploded front perspective view showing a tubular ionizer embodiment of the invention and a static sensor.

FIG. 3 is a partial exploded front perspective view of the system 10A of FIG. 2. FIG. 3 illustrates the embodiment of the present system 10A where a tubular ionizer 16 is coupled to the end of a discharge hose 14, i.e., at the discharge opening 18. A power line, which is coupled to power source 20, is shown connected to the ionizer 16. The discharge hose 14 is shown with a static sensor 22 disposed therein. A signal line is shown connected to the sensor 22 and couples the controller 24 to the sensor 22. Again, the flow path of the loose-fill insulation through the discharge hose 14 and ionizer 16 is shown by directional arrows.

The method and system described above reduce or eliminate static charge on loose-fill insulation blown from a discharge hose. The system and method thereby improve control of the discharge stream while reducing waste and unwanted coverage by the blown insulation. Still further, these benefits may be obtained while eliminating or greatly reducing the use of expensive, corrosive and hydrophilic antistatic chemicals.

It should be understood that the present method and system may be utilized in a variety of blowing applications in addition to application of blown insulation to structures, including, for example, manufacturing, packaging and preconditioning of insulation. "Preconditioning" is the process of taking high density bags of insulation and breaking the fiber into small, low density tufts of glass fiber that are conveyed through and air lock in the blowing machine and into a blowing hose. Preconditioning is achieved with paddles and an auger located in the bottom of the blowing machine. It should also be understood that loose fill insulation may include glass fibers, mineral wool, or cellulose, or combinations thereof, for example.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention

What is claimed is:

1. A system for blowing loose-fill insulation, comprising:

a loose-fill blowing machine including a discharge hose;

an ionizer disposed in a flow path afraid insulation through said discharge hose, wherein said ionizer reduces static charge developed on said insulation prior to discharge thereof;

a static sensor disposed in said flow path to measure said static charge; and a controller configured to control said ionizer to reduce said static charge in response to a static charge level detected by said static sensor.

2. The system of claim 1, wherein said ionizer is disposed proximate to a discharge opening of said discharge hose.

3. The system of claim 1, wherein said ionizer is tubularly shaped.

4. The system of claim 1, wherein said loose-fill insulation includes glass fiber insulation.

5. The system of claim 1, wherein said controller includes a programmable logic controller.

6. The system of claim 1, wherein said ionizer produces both cationic and anionic ions.

7. A method of reducing static charge developed on loose-fill insulation during blowing, comprising the steps of:

ionizing said insulation in a flow path of said insulation while said insulation is being discharged during installation to reduce said static charge;

measuring a level of said static charge; and controlling said ionizer to reduce said static charge in response to a measurement of said level.

8. The method of claim 7, wherein said ionizing step includes the step of disposing an ionizer in said flow path, said flow path including a discharge hose of a loose-fill blowing machine.

9. The method of claim 8, wherein said ionizer is disposed proximate to a discharge opening of said discharge hose.

10. The method of claim 7, wherein said controlling step includes the step of adjusting a power of said ionizer.

11. The method of claim 7, wherein said loose-fill insulation includes glass fiber insulation.

12. The method of claim 7, wherein said ionizing step includes the step of generating an ion field including both cationic and anionic ions.

13. A method of blowing loose-fill insulation, comprising the steps of:

blowing loose-fill insulation using a loose-fill blowing machine including a discharge hose, said loose-fill insulation developing a static charge thereon in a flow path through said discharge hose; end ionizing said insulation in a flow path of said insulation while said insulation is being discharged to reduce said static charge;

measuring a level of said static charge; and controlling said ionizing step to reduce said static charge in response to a measurement of said level.

14. The method of claim 13, wherein said ionizing step includes the step of disposing an ionizer in said flow path.

15. The method of claim 14, wherein said ionizer is disposed proximate to a discharge opening of said discharge hose.

16. The method of claim 15, wherein said controlling step includes the step of adjusting a power of said ionizer.

17. The method of claim 13, wherein said loose-fill insulation includes glass fiber insulation.

18. The method of claim 13, wherein said ionizing step includes the step of generating an ion field including both cationic and anionic ions.

19. A method of blowing loose-fill insulation comprising glass fiber, comprising the steps of:

passing said insulation through an ionized atmosphere while said insulation is being discharged for installation, whereby static charge is reduced;

measuring a level of said static charge; and controlling said ionized atmosphere to reduce said static charge in response to a measurement of said level.

20. The method of claim 19, wherein said ionized atmosphere includes both cationic and anionic ions.

* * * * *

UNITED STATES PATENT AND TRADEMARK OFFICE

CERTIFICATE OF CORRECTION

PATENT NO. : 6,732,960 B2
DATED : May 11, 2004
INVENTOR(S) : Wayne Shaw and Joseph Michetti It is certified that error appears in the above-identified patent and that said Letters Patent is hereby corrected as shown below:

Column 5,
Line 4, delete “afraid” and insert therefor -- of said --; and

Column 6,
Line 9, delete “end”

Signed and Sealed this

Seventh Day of September, 2004

JON W. DUDAS
*Director of the United States Patent and Trademark Office*